US010476123B2

(12) United States Patent
Baba et al.

(10) Patent No.: US 10,476,123 B2
(45) Date of Patent: Nov. 12, 2019

(54) TRANSMISSION LINE

(71) Applicant: Murata Manufacturing Co., Ltd., Nagaokakyo-shi, Kyoto-fu (JP)

(72) Inventors: Takahiro Baba, Nagaokakyo (JP); Satoshi Sasaki, Nagaokakyo (JP); Kuniaki Yosui, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 2 days.

(21) Appl. No.: 15/361,595

(22) Filed: Nov. 28, 2016

(65) Prior Publication Data

US 2017/0077578 A1 Mar. 16, 2017

Related U.S. Application Data

(63) Continuation of application No. PCT/JP2015/064685, filed on May 22, 2015.

(30) Foreign Application Priority Data

Jun. 2, 2014 (JP) ..... 2014-113732

(51) Int. Cl.
*H01P 3/08* (2006.01)

(52) U.S. Cl.
CPC ..... *H01P 3/08* (2013.01); *H01P 3/088* (2013.01)

(58) Field of Classification Search
CPC .. H01P 3/08; H01P 3/081; H01P 3/082; H01P 3/085; H01P 3/088
(Continued)

(56) References Cited

U.S. PATENT DOCUMENTS 7,660,131 B2 * 2/2010 Drouillard ..... H01R 12/721 361/749
2008/0149376 A1 6/2008 Saito
(Continued)

FOREIGN PATENT DOCUMENTS

JP 3-44307 * 4/1991 ..... H01P 3/08
JP 3-44307 U 4/1991
(Continued)

OTHER PUBLICATIONS

Official Communication issued in corresponding International Application PCT/JP2015/064685, dated Aug. 4, 2015.
(Continued)

*Primary Examiner* — Stephen E. Jones
(74) *Attorney, Agent, or Firm* — Keating & Bennett, LLP

(57) ABSTRACT

A transmission line includes a dielectric base body including a first and second base bodies. Each of the first and second base bodies includes dielectric layers stacked on top of one another. The first base body includes a first signal conductor located between ground conductors in a stacking direction. The second base body includes a second signal conductor located between ground conductors in the stacking direction. The first and second base bodies are brought together so that one of the ground conductors of the first base body and one of the ground conductors of the second base body abut against or are adjacent to each other. Lead conductors defining both ends of the first signal conductor and lead conductors defining both ends of the second signal conductor are exposed on a mounting surface of the dielectric base body parallel or substantially parallel to the stacking direction.

18 Claims, 9 Drawing Sheets

(58) Field of Classification Search
USPC ..... 333/1, 4, 5, 238, 246, 33
See application file for complete search history.

(56) References Cited

U.S. PATENT DOCUMENTS

| | | | | |
|---|---|---|---|---|
| 2012/0097433 | A1 | 4/2012 | Kato et al. | |
| 2012/0229998 | A1* | 9/2012 | Kagaya | H01P 1/02 361/777 |
| 2013/0147581 | A1 | 6/2013 | Kato et al. | |

FOREIGN PATENT DOCUMENTS

| | | | |
|---|---|---|---|
| JP | 04-373203 | A | 12/1992 |
| JP | 8-78915 | A | 3/1996 |
| JP | 2008-160750 | A | 7/2008 |
| JP | 4962660 | B2 | 6/2012 |
| WO | 2012/074101 | A1 | 6/2012 |

OTHER PUBLICATIONS

Official Communication issued in a corresponding Japanese Patent Application No. 2016-525771, dated Mar. 7, 2017.

* cited by examiner

TRANSMISSION LINE

CROSS REFERENCE TO RELATED APPLICATIONS

This application claims the benefit of priority to Japanese Patent Application 2014-113732 filed on Jun. 2, 2014 and is a Continuation Application of PCT/JP2015/064685 filed on May 22, 2015. The entire contents of each application are hereby incorporated herein by reference.

BACKGROUND OF THE INVENTION

1. Field of the Invention

The present invention relates to transmission lines in which signal conductors are located close to one another and transmit different high frequency signals.

2. Description of the Related Art

Various types of transmission lines transmit high frequency signals. For example, a transmission line described in Japanese Patent No. 4962660 includes a stripline structure. The transmission line described in Japanese Patent No. 4962660 includes an elongated dielectric base body extending in a transmission direction of high frequency signals, a signal conductor, and a first ground conductor, and a second ground conductor. The signal conductor is located at a midway position in a thickness direction of the dielectric base body. The signal conductor is located between the first ground conductor and the second ground conductor in the thickness direction, that is, a stacking direction, of the dielectric base body. Furthermore, the first ground conductor and the second ground conductor are connected to each other via a plurality of via-hole conductors arranged along the signal conductor. Accordingly, a transmission line including a stripline structure with a signal conductor located between first and second ground conductors is provided.

For example, if a plurality of transmission lines as described in Japanese Patent No. 4962660 are located close to one another in a communication device or the like, a plurality of signal conductors are likely to be located on a single dielectric base body. Accordingly, the plurality of signal conductors may be spaced from each other in a direction orthogonal or substantially orthogonal to the thickness direction of the dielectric base body and a signal transmission direction.

In a transmission line in which a dielectric base body includes a single unit defined by arranging and connecting transmission lines each including the structure described in Japanese Patent No. 4962660 to each other in a width direction of the dielectric base body, interlayer connection conductors located between the signal conductors significantly reduces or prevents coupling between signal conductors that are adjacent to or in a vicinity of one another.

In the configuration described above in which interlayer connection conductors are arranged between signal conductors that are adjacent to or in a vicinity of one another, however, a reduction in the number of interlayer connection conductors or a removal of interlayer connection conductors may result in the signal conductors being likely to be coupled to each other. In contrast, an increase in the number of interlayer connection conductors may cause unnecessary coupling to be likely to occur between the signal conductors and the interlayer connection conductors, making it difficult to achieve a desired impedance of a transmission line. In particular, a reduction in the width of the dielectric base body further results in it being more difficult to significantly reduce or prevent unnecessary coupling between the interlayer connection conductors and the signal conductors.

Moreover, the arrangement of interlayer connection conductors between signal conductors does not facilitate a reduction in the width of the dielectric base body.

SUMMARY OF THE INVENTION

Preferred embodiments of the present invention provide a relatively small transmission line in which coupling between a plurality of signal conductors is significantly reduced or prevented even when the plurality of signal conductors are included in a single dielectric base body.

A transmission line according to a preferred embodiment of the present invention includes a dielectric base body including a plurality of dielectric layers that are stacked on top of one another, a plurality of signal conductors located in the dielectric base body, and a first ground conductor located on one of the plurality of dielectric layers and facing the plurality of signal conductors. The plurality of signal conductors include a first signal conductor including a film shape and a second signal conductor including a film shape, the first signal conductor and the second signal conductor being located at different positions in a stacking direction of the plurality of dielectric layers. The first ground conductor includes a film shape including a width wider than a width of the first signal conductor and a width of the second signal conductor, and is located between the first signal conductor and the second signal conductor in the stacking direction of the plurality of dielectric layers.

According to the preferred embodiment described above, the first ground conductor arranged between the plurality of signal conductors in the stacking direction may significantly reduce or prevent coupling between the first signal conductor and the second signal conductor. Thus, the preferred embodiment described above may provide high isolation between a first transmission line including the first signal conductor and a second transmission line including the second signal conductor even in a small dielectric base body with reduced space between the first signal conductor and the second signal conductor.

In the transmission line according to the preferred embodiment described above, preferably, at least one end of each of the first signal conductor and the second signal conductor is curved in a direction orthogonal or substantially orthogonal to the stacking direction as viewed in the stacking direction and is exposed to an exterior of the transmission line from a surface of the dielectric base body orthogonal or substantially orthogonal to the stacking direction, for example.

According to the preferred embodiment described above, an exposed conductor portion may be included as a terminal for external connection or as a connection unit to be connected to the terminal for external connection. That is, a transmission line including a transmission line including an external connection terminal may be easily fabricated.

The transmission line according to the preferred embodiment described above preferably includes the following configuration, for example. The transmission line includes a plurality of ground conductors and the ground conductors include a first, second, third ground conductors. The second ground conductor is located opposite the first ground conductor with the first signal conductor positioned between the first ground conductor and the second ground conductor in the stacking direction of the dielectric layers. The third ground conductor is located opposite the first ground conductor with the second signal conductor positioned between the first ground conductor and the third ground conductor in the stacking direction of the dielectric layers.

According to the preferred embodiment described above, each of the first signal conductor and the second signal conductor is located between ground conductors. Thus, the preferred embodiment described above provides a first transmission line including the first signal conductor and a second transmission line including the second signal conductor as stripline transmission lines. Thus, external radiation from the first and second transmission lines may be significantly reduced or prevented.

Preferably, the transmission line according to the preferred embodiment described above further includes a ground connection conductor located on the surface of the dielectric base body orthogonal or substantially orthogonal to the stacking direction and adapted to connect the first ground conductor, the second ground conductor, and the third ground conductor, for example.

According to the preferred embodiment described above, the ground of each transmission line is stabilized and stable transmission characteristics are provided.

In addition, the transmission line according to the preferred embodiment described above preferably includes the following configuration, for example. The transmission line further includes a first auxiliary ground conductor located in a layer identical to a layer in which the first signal conductor is located, and a second auxiliary ground conductor located in a layer identical to a layer in which the second signal conductor is located. The ground connection conductor is also connected to the first auxiliary ground conductor and the second auxiliary ground conductor.

According to the preferred embodiment described above, the space between conductors to which the ground connection conductor is connected in the stacking direction in the dielectric base body may be reduced. Thus, a ground connection conductor may be more easily defined on the surface of the dielectric base body orthogonal or substantially orthogonal to the stacking direction.

In the transmission line according to the preferred embodiment described above, at least one of the second ground conductor and the third ground conductor may include an opening portion or a cutaway portion, the opening portion or the cutaway portion being an area where no conductor is defined.

According to the preferred embodiment described above, the distance between the first signal conductor and the second ground conductor and the distance between the second signal conductor and the third ground conductor may be reduced, while also significantly reducing or preventing external radiation from the first and second transmission lines. Thus, a smaller transmission line may be provided.

In the transmission line according to the preferred embodiment described above, preferably, a partial air layer is defined between the first signal conductor and the first ground conductor, and a partial air layer is defined between the second signal conductor and the first ground conductor, for example. For example, through holes extending through the dielectric base body are defined in a direction in which the first signal conductor and the second signal conductor extend and in the direction orthogonal or substantially orthogonal to the stacking direction between the first signal conductor and the first ground conductor and between the second signal conductor and the first ground conductor.

According to the preferred embodiment described above, a dielectric constant between the first signal conductor and the first ground conductor and a dielectric constant between the second signal conductor and the first ground conductor may be reduced. Thus, the preferred embodiment described above may reduce the space between the first signal conductor and the first ground conductor and the space between the second signal conductor and the first ground conductor, and also provide a smaller transmission line. In addition, the flexibility of the transmission line may be increased.

According to a preferred embodiment of the present invention, a small transmission line in which coupling between a plurality of signal conductors is significantly reduced or prevented even when the plurality of signal conductors are included in a single dielectric base body is provided.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1A:
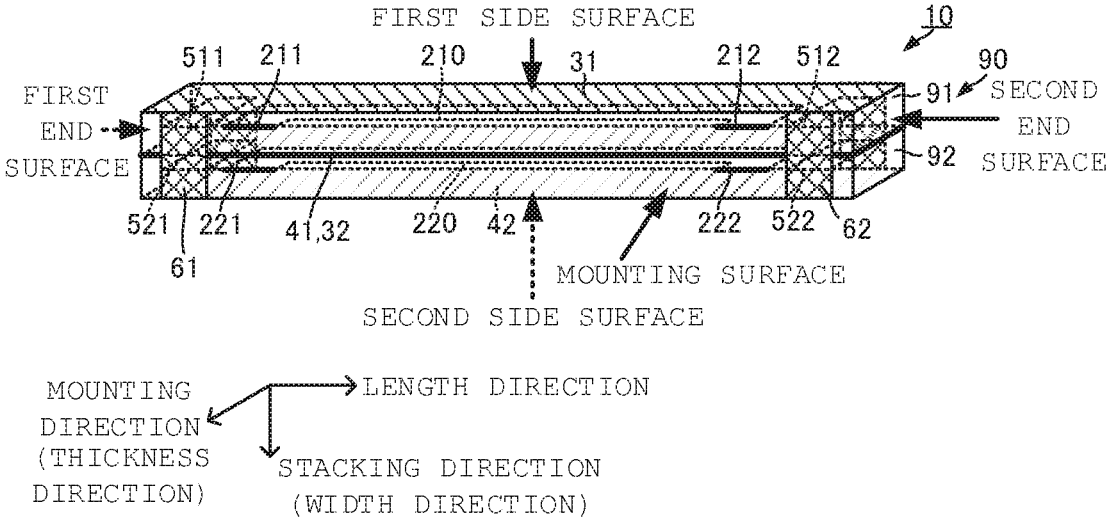
FIG. 1A and FIG. 1B are external perspective views of a transmission line according to a first preferred embodiment of the present invention.
Figure 1B:
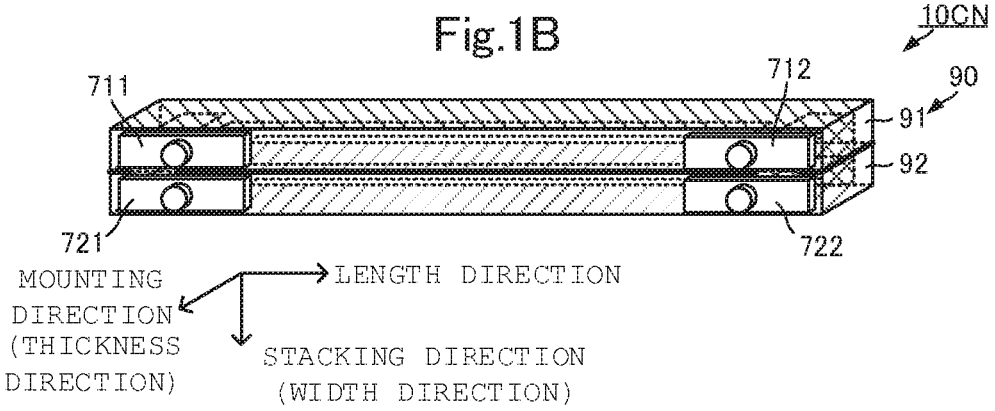

A transmission line according to a first preferred embodiment of the present invention is described below with reference to the drawings. FIG. 1A and FIG. 1B are external perspective views of the transmission line according to the first preferred embodiment. FIG. 1A and FIG. 1B are external perspective views of the transmission line as viewed from a mounting surface, a first side surface, and a second end surface. FIG. 1A is an external perspective view of a transmission line including no connector terminals. FIG. 1B is an external perspective view of a transmission line including connector terminals.

Figure 2A:
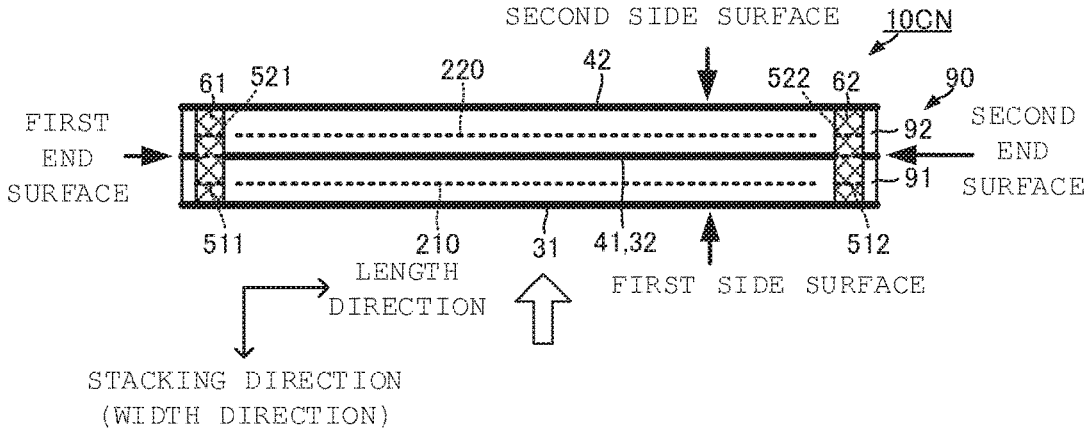
FIG. 2A, FIG. 2B, and FIG. 2C are three-view drawings of the transmission line according to the first preferred embodiment of the present invention.
Figure 2B:
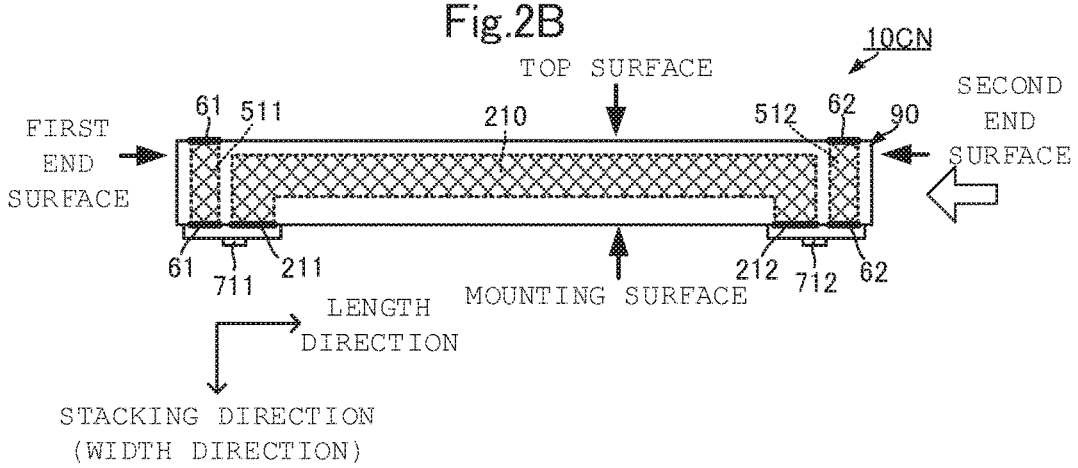
Figure 2C:
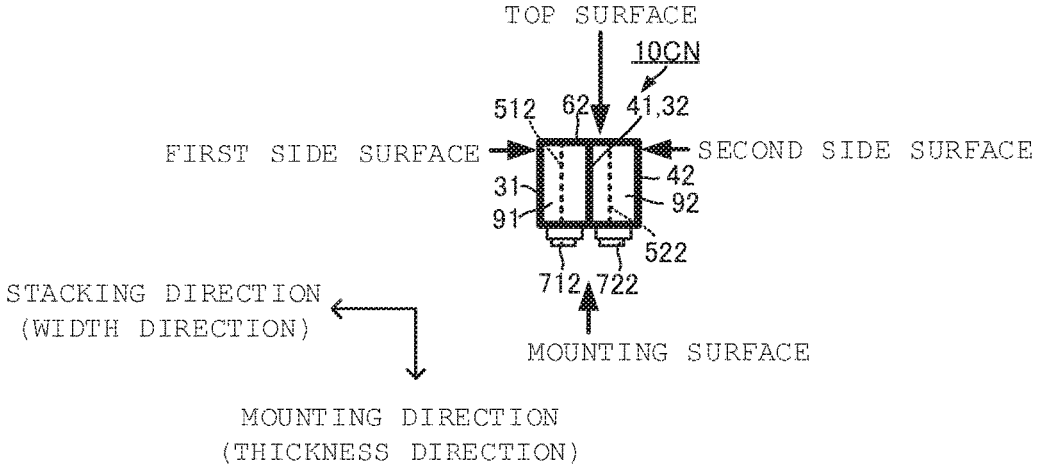

FIG. 2A, FIG. 2B, and FIG. 2C are three-view drawings of the transmission line according to the first preferred embodiment. FIG. 2A is a view of the transmission line according to the first preferred embodiment as viewed from a top surface. FIG. 2B is a view of the transmission line according to the first preferred embodiment as viewed from the first side surface. In FIG. 2B, the illustration of ground conductors on side surfaces of a dielectric base body is omitted for ease of understanding of the internal structure. FIG. 2C is a view of the transmission line according to the first preferred embodiment as viewed from the second end surface.

Figure 3A:
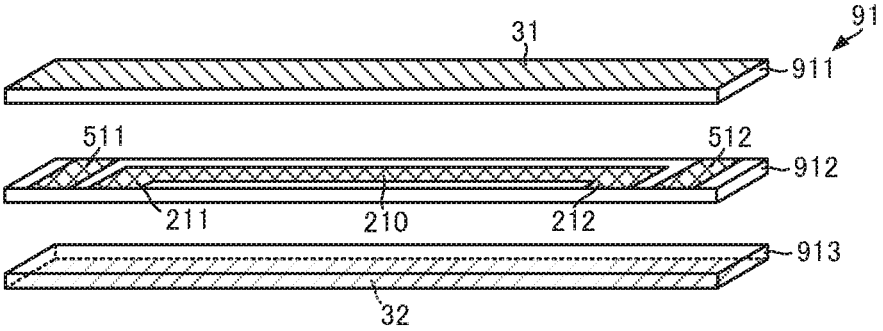
FIG. 3A, FIG. 3B, and FIG. 3C are views illustrating the structure of the transmission line according to the first preferred embodiment of the present invention.
Figure 3B:
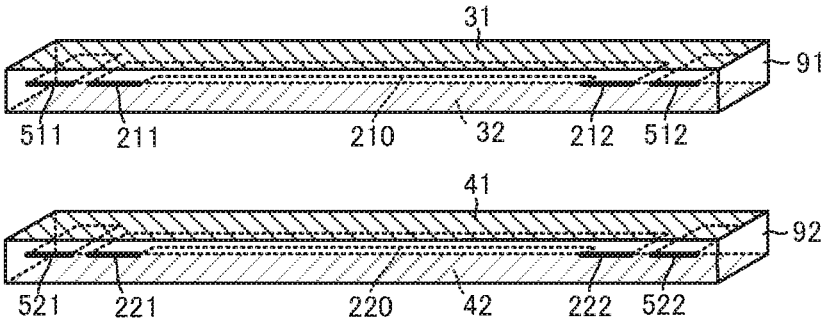
Figure 3C:
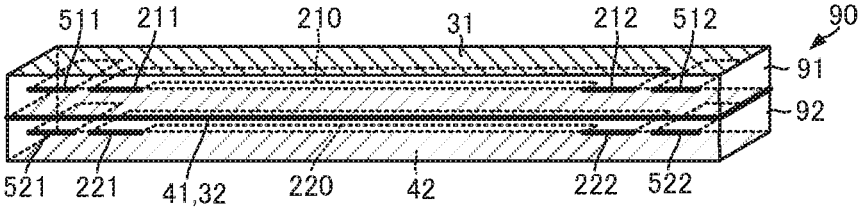

FIG. 3A, FIG. 3B, and FIG. 3C are views illustrating the structure of the transmission line according to the first preferred embodiment. FIG. 3A is an exploded perspective view of a first base body of the transmission line according to the first preferred embodiment. FIG. 3B is a perspective view of the dielectric base body in the transmission line according to the first preferred embodiment when the dielectric base body is separated into the first base body and a second base body. FIG. 3C is an external perspective view of the dielectric base body in the transmission line according to the first preferred embodiment.

As illustrated in FIG. 1A, a transmission line 10 includes a dielectric base body 90 including a rectangular parallelepiped or a substantially rectangular parallelepiped shape. The dielectric base body 90 includes a first base body 91 and a second base body 92. The first base body 91 and the second base body 92 include the same or substantially the same basic elements and features.

As illustrated in FIG. 3A, the first base body 91 includes dielectric layers 911, 912, and 913. The dielectric layers 911, 912, and 913 include film shapes, are flexible, and include an insulating material. For example, the dielectric layers 911, 912, and 913 include a material mainly containing a liquid crystal polymer.

A front surface of the dielectric layer 911 is entirely or substantially entirely covered by a ground conductor 31.

A front surface of the dielectric layer 912 includes a first signal conductor 210 and auxiliary ground conductors 511 and 512.

The first signal conductor 210 includes a conductor with a film shape, the conductor including a principal portion that extends in a transmission direction of high frequency signals and including a predetermined width in a direction orthogonal or substantially orthogonal to the transmission direction. The principal portion of the first signal conductor 210 includes a length that does not reach both ends in a length direction of the dielectric layer 912.

A first end of the first signal conductor 210 in the length direction is bent to define a lead conductor 211. The lead conductor 211 extends in a width direction of the dielectric layer 912, reaches a mounting surface of the dielectric layer 912, and is exposed to an exterior of the transmission line 10.

A second end of the first signal conductor 210 in the length direction is also bent to define a lead conductor 212. The lead conductor 212 extends in the width direction of the dielectric layer 912, reaches the mounting surface of the dielectric layer 912, and is exposed to an exterior of the transmission line 10.

The auxiliary ground conductor 511 is defined in an area on the front surface of the dielectric layer 912 between the first end of the first signal conductor 210 in the length direction and a first end surface of the dielectric layer 912. The auxiliary ground conductor 511 is defined on the front surface of the dielectric layer 912 and continuously extends from the mounting surface of the dielectric layer 912 to a top surface of the dielectric layer 912.

The auxiliary ground conductor 512 is defined in an area on the front surface of the dielectric layer 912 between the second end of the first signal conductor 210 in the length direction and a second end surface of the dielectric layer 912. The auxiliary ground conductor 512 is defined on the front surface of the dielectric layer 912 and continuously extends from the mounting surface of the dielectric layer 912 to the top surface of the dielectric layer 912.

The entire or substantially the entire area of a rear surface of the dielectric layer 913 includes a ground conductor 32.

The dielectric layers 911, 912, and 913 are stacked on top of one another so that the respective front surfaces and rear surfaces are parallel or substantially parallel to one another. A multilayer body including the dielectric layers 911, 912, and 913 define the first base body 91.

Accordingly, as illustrated in FIG. 3B, the first base body 91 includes the first signal conductor 210, which includes a film shape and is located between the ground conductors 31 and 32 in the stacking direction. Each of the ground conductors 31 and 32 includes a width wider than the width of the first signal conductor 210. The lead conductor 211, which is located at the first end of the first signal conductor 210, is exposed on the mounting surface of the first base body 91. The lead conductor 212, which is located at the second end of the first signal conductor 210, is also exposed on the mounting surface of the first base body 91. The first base body 91 also includes the auxiliary ground conductors 511 and 512, which are located between the ground conductors 31 and 32 in the stacking direction. The auxiliary ground conductors 511 and 512 are exposed on the mounting surface and the top surface of the first base body 91.

As illustrated in FIG. 3B, the second base body 92 includes a second signal conductor 220, which includes a film shape and is located between ground conductors 41 and 42 in the stacking direction. Each of the ground conductors 41 and 42 includes a width wider than the width of the second signal conductor 220. A lead conductor 221, which defines a first end of the second signal conductor 220, is exposed on a mounting surface of the second base body 92. A lead conductor 222, which defines a second end of the second signal conductor 220, is also exposed on the mounting surface of the second base body 92. The second base body 92 also includes auxiliary ground conductors 521 and 522 located between the ground conductors 41 and 42 in the stacking direction. The auxiliary ground conductors 521 and 522 are exposed on the mounting surface and the top surface of the second base body 92.

As illustrated in FIG. 3C, the first base body 91 and the second base body 92 are stacked on top of each other, and the ground conductor 32 of the first base body 91 and the ground conductor 41 of the second base body 92 abut against or are adjacent to each other. In other words, the first base body 91 and the second base body 92 are stacked on top of each other, and the stacking direction of the dielectric layers defining the first base body 91 and the stacking direction of the dielectric layers defining the second base body 92 coincide with each other. The first base body 91 and the second base body 92 include the same or substantially the same outer shape, and are stacked on top of each other so that the mounting surface of the first base body 91 and the mounting surface of the second base body 92 are flush with each other and the first end surface of the first base body 91 and the first end surface of the second base body 92 are flush with each other.

Accordingly, as illustrated in FIG. 3C, the dielectric base body 90 includes the first base body 91 and the second base body 92 are stacked on top of each other. The dielectric base body 90 includes the ground conductor 31, the first signal conductor 210, the ground conductors 32 and 41, the second signal conductor 220, and the ground conductor 42 are arranged in the stacking direction of the dielectric layers. The dielectric base body 90 also includes the lead conductors 211 and 212 of the first signal conductor 210 and the lead conductors 221 and 222 of the second signal conductor 220 are exposed on the mounting surface of the dielectric base body 90.

The first preferred embodiment provides the dielectric base body 90 in which a first transmission line including a slot line structure in which the first signal conductor 210 is located between the ground conductor 31 and the ground conductor 32, or between the ground conductor 31 and the ground conductor 41, and a second transmission line including a slot line structure in which and the second signal conductor 220 is located between the ground conductor 41 and the ground conductor 42, or between the ground conductor 32 and the ground conductor 42, are defined. The ground conductors 32 and 41 correspond to a first ground conductor, the ground conductor 31 corresponds to a second ground conductor, and the ground conductor 42 corresponds to a third ground conductor.

As illustrated in FIG. 1A, the direction in which the ground conductor 31, the first signal conductor 210, and the ground conductor 32 or the ground conductor 41 are arranged in the first transmission line and the direction in which the ground conductor 41 or the ground conductor 32, the second signal conductor 220, and the ground conductor 42 are arranged in the second transmission line are parallel or substantially parallel to the mounting surface of the dielectric base body 90. In other words, the flat film surfaces of the ground conductor 31, the first signal conductor 210, and the ground conductor 32 or the ground conductor 41 of the first transmission line and the flat film surfaces of the ground conductor 41 or the ground conductor 32, the second signal conductor 220, and the ground conductor 42 of the second transmission line are orthogonal or substantially orthogonal to the mounting surface of the dielectric base body 90.

The first preferred embodiment reduces the space between the first signal conductor 210 and the second signal conductor 220 by merely reducing the thickness of dielectric layers so as to obtain the desired impedance, resulting in a reduction in the width of the dielectric base body 90.

In the first preferred embodiment, the ground conductors 32 and 41, which include widths wider than the widths of the first and second signal conductors 210 and 220, are arranged between the first signal conductor 210 and the second signal conductor 220. Accordingly, coupling between the first signal conductor 210 and the second signal conductor 220 even when the space between the first signal conductor 210 and the second signal conductor 220 is significantly reduced or prevented. Accordingly the first transmission line and the second transmission line are isolated or substantially isolated from each other, even when the dielectric base body 90 in which the first transmission line and the second transmission line are defined is small in size.

According to the first preferred embodiment, the widths of the first and second signal conductors 210 and 220 may be increased in accordance with the widths of the dielectric layers. Thus, the transmission loss of the first and second signal conductors 210 and 220 may be significantly reduced.

The mounting surface and the top surface of the dielectric base body 90 include ground connection conductors 61 and 62. The ground connection conductor 61 connects the ground conductor 31, the auxiliary ground conductor 511, the ground conductors 32 and 41, the auxiliary ground conductor 521, and the ground conductor 42. The ground connection conductor 62 connects the ground conductor 31, the auxiliary ground conductor 512, the ground conductors 32 and 41, the auxiliary ground conductor 522, and the ground conductor 42. The auxiliary ground conductors 511 and 512 correspond to a first auxiliary ground conductor, and the auxiliary ground conductors 521 and 522 correspond to a second auxiliary ground conductor.

Accordingly, the transmission line 10 is provided in which the ground connection conductors 61 and 62, which are located on the mounting surface, are included as external ground terminals, the lead conductors 211 and 212, which are exposed on the mounting surface, are included as external connection terminals of the first transmission line, and the lead conductors 221 and 222, which are exposed on the mounting surface, are included as external connection terminals of the second transmission line.

As described above, the first signal conductor 210 is located between the ground conductor 31 and the ground conductor 32, and the ground conductor 31 and the ground conductor 32 are electrically connected to stabilize the ground of the first transmission line. The second signal conductor 220 is located between the ground conductor 41 and the ground conductor 42, and the ground conductor 41 and the ground conductor 42 are electrically connected to stabilize the ground of the second transmission line. In addition, the electrical connection of the ground conductors 31, 32, 41, and 42 by the ground connection conductors 61 and 62 further stabilizes the ground of the transmission line 10.

The auxiliary ground conductors 511, 512, 521, and 522 may be omitted. However, by including the auxiliary ground conductors 511, 512, 521, and 522, the space between ground conductors in the stacking direction may be reduced and the ground connection conductors 61 and 62 may be more easily defined, which provides an electrical connection to the ground conductors 31, 32, 41, and 42, by including electrolytic plating or the like and reliability may be improved.

In the transmission line 10 according to the first preferred embodiment, the ground connection conductors 61 and 62 are defined on the mounting surface and the top surface. Alternatively, the ground connection conductors 61 and 62 may be defined at least on the mounting surface.

In contrast to the transmission line 10, a transmission line 10CN illustrated in FIG. 1B includes connector terminals 711, 712, 721, and 722. The connector terminals 711, 712, 721, and 722 are located on the mounting surface of the dielectric base body 90. The connector terminals 711, 712, 721, and 722 are coaxial connectors. An inner conductor of the connector terminal 711 is connected to the lead conductor 211 of the first signal conductor 210, and an outer conductor of the connector terminal 711 is connected to the ground connection conductor 61. An inner conductor of the connector terminal 712 is connected to the lead conductor 212 of the first signal conductor 210, and an outer conductor of the connector terminal 712 is connected to the ground connection conductor 62. An inner conductor of the connector terminal 721 is connected to the lead conductor 221 of the second signal conductor 220, and an outer conductor of the connector terminal 721 is connected to the ground connection conductor 61. An inner conductor of the connector terminal 722 is connected to the lead conductor 222 of the second signal conductor 220, and an outer conductor of the connector terminal 722 is connected to the ground connection conductor 62.

The connector terminals 711, 712, 721, and 722 described above may facilitate the mounting of the transmission line 10CN onto an external circuit substrate, and improve reliability in mounting.

The transmission lines 10 and 10CN including the structure described above are fabricated in the following way, for example.

First, a one-side-copper-clad dielectric film, which corresponds to a dielectric layer, is prepared. The entire or substantially the entire area of one side of the one-side-copper-clad dielectric film includes copper foil cladding. In the first preferred embodiment, the dielectric film includes a liquid crystal polymer. For example, the liquid crystal polymer may have a low dielectric constant prevents or reduces an increase in capacitance even when a signal conductor and a ground conductor are close to each other. In addition, low dielectric loss tangent reduces transmission loss, and low temperature dependence of the dielectric loss tangent significantly reduces or prevents a characteristic change due to the environment.

The ground conductor 31 is included on a front surface of a first dielectric film, which corresponds to the dielectric layer 911. The first signal conductor 210 and the auxiliary ground conductors 511 and 512 are included on a front surface of a second dielectric film, which corresponds to the dielectric layer 912, by patterning and the like. The ground conductor 32 is included on a rear surface of a third dielectric film, which corresponds to the dielectric layer 913. The plurality of dielectric films, namely, the first, second, and third dielectric films, are stacked on top of one another and are subjected to thermocompression bonding to form the first base body 91.

The second base body 92 is fabricated through a process similar to that of the first base body 91.

The first base body 91 and the second base body 92 are brought together so that the ground conductor 32 and the ground conductor 41 abut against each other. A conductive adhesive or a conductive glue may be provided between the ground conductor and the ground conductor 41 to adhere or bond the ground conductor 32 and the ground conductor 41 to each other. Accordingly, the dielectric base body 90 is fabricated.

Then, the ground connection conductors 61 and 62 are included on the mounting surface and the top surface of the dielectric base body 90 by including electrolytic plating or the like. Accordingly, the transmission line 10 is fabricated.

Further, the connector terminals 711, 712, 721, and 722 are mounted on the mounting surface of the transmission line 10. Accordingly, the transmission line 10CN with connector terminals is fabricated.

Second Preferred Embodiment

Figure 4A:
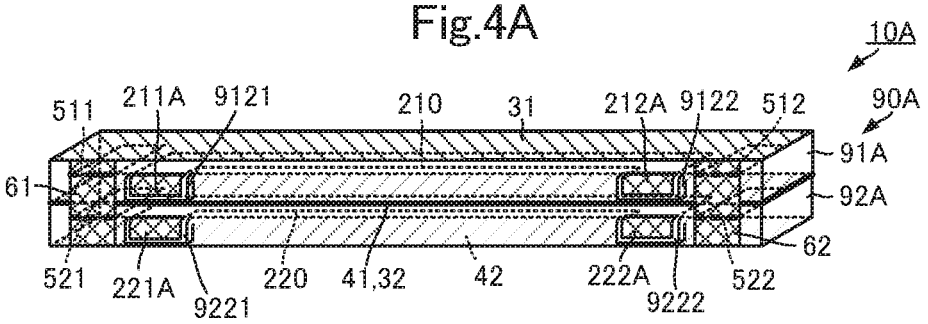
FIG. 4A and FIG. 4B are views illustrating the structure of a transmission line according to a second preferred embodiment of the present invention.
Figure 4B:
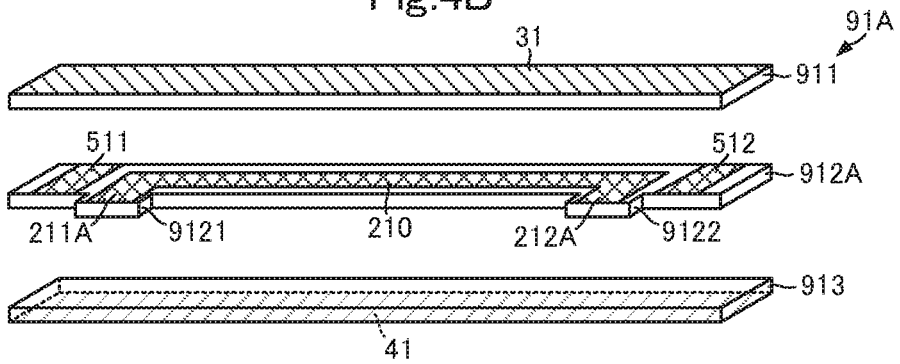

A transmission line according to a second preferred embodiment of the present invention is described below with reference to the drawings. FIG. 4A and FIG. 4B are views illustrating the structure of the transmission line according to the second preferred embodiment. FIG. 4A is an external perspective view of the transmission line according to the second preferred embodiment. FIG. 4B is an exploded perspective view of a first base body of the transmission line according to the second preferred embodiment.

As illustrated in FIG. 4A, a transmission line 10A according to the second preferred embodiment is different from the transmission line 10 according to the first preferred embodiment in the specific configuration and arrangement of a first base body 91A, a second base body 92A, lead conductors 211A and 212A of the first signal conductor 210, and lead conductors 221A and 222A of the second signal conductor 220. Other elements and features of the second preferred embodiment are the same or substantially the same as that of the transmission line 10 according to the first preferred embodiment.

As illustrated in FIG. 4B, the first base body 91A includes projecting portions 9121 and 9122 that project from the mounting surface. The projecting portion 9121 is located in a portion where the lead conductor 211A of the first signal conductor 210 is exposed from the mounting surface of the first base body 91A. The projecting portion 9122 is located in a portion where the lead conductor 212A of the first signal conductor 210 is exposed from the mounting surface of the first base body 91A. The projecting portions 9121 and 9122 include a thickness equal to the thickness of a dielectric layer 912A in which the first signal conductor 210 of the first base body 91A is defined.

The lead conductor 211A extends over a surface of the projecting portion 9121. The lead conductor 212A extends over a surface of the projecting portion 9122. The projecting portions 9121 and 9122 are folded so that the surfaces on which the lead conductors 211A and 212A are defined are parallel or substantially parallel to the mounting surface of the first base body 91A. The projecting portions 9121 and 9122 are folded so that surfaces on which the lead conductors 211A and 212A are not provided abut against or are adjacent to the mounting surface of the first base body 91A.

The second base body 92A includes projecting portions 9221 and 9222 that project from the mounting surface. The projecting portion 9221 is located in a portion where the lead conductor 221A of the second signal conductor 220 is exposed from the mounting surface of the second base body 92A. The projecting portion 9222 is located in a portion where the lead conductor 222A of the second signal conductor 220 is exposed from the mounting surface of the second base body 92A. The projecting portions 9221 and 9222 include a thickness equal or substantially equal to the thickness of a dielectric layer in which the second signal conductor 220 of the second base body 92A is defined.

The lead conductor 221A extends over a surface of the projecting portion 9221. The lead conductor 222A extends over a surface of the projecting portion 9222. The projecting portions 9221 and 9222 are folded so that the surfaces on which the lead conductors 221A and 222A are provided are parallel or substantially parallel to the mounting surface of the second base body 92A. The projecting portions 9221 and 9222 are folded so that surfaces on which the lead conductors 221A and 222A are not defined abut against or are adjacent to the mounting surface of the second base body 92A.

The second preferred embodiment provides a terminal pattern including a predetermined area and including the lead conductors 211A, 212A, 221A, and 222A on the mounting surface of a dielectric base body 90A. Accordingly, if the transmission line 10A is directly mounted onto an external circuit or connector terminals are connected to the mounting surface of the dielectric base body 90A, reliability in mounting or reliability in connection between the lead conductors 211A, 212A, 221A, and 222A and the connector terminals may be improved. Thus, a more reliable transmission line is provided.

Third Preferred Embodiment

Figure 5A:
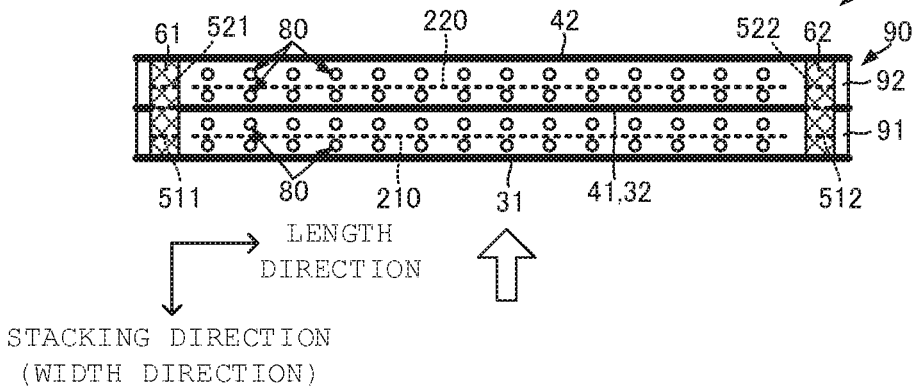
FIG. 5A and FIG. 5B are two-view drawings of a transmission line according to a third preferred embodiment of the present invention.
Figure 5B:
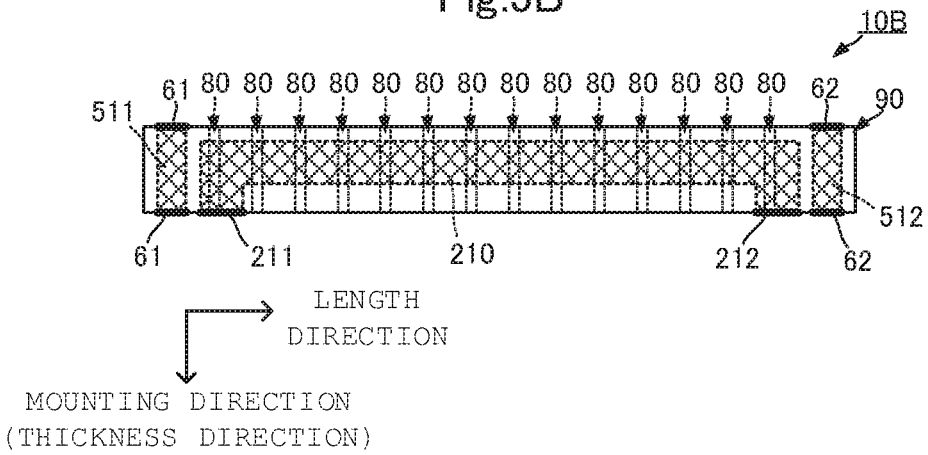

A transmission line according to a third preferred embodiment of the present invention is described below with reference to the drawings. FIG. 5A and FIG. 5B are two-view drawings of the transmission line according to the third preferred embodiment. FIG. 5A is a view of the transmission line according to the third preferred embodiment as viewed from the top surface. FIG. 5B is a view of the transmission line according to the third preferred embodiment as viewed from the first side surface. In FIG. 5B, the illustration of ground conductors on side surfaces of a dielectric base body is omitted for ease of understanding of the internal structure.

A transmission line 10B according to the third preferred embodiment includes through holes 80 that are added to the transmission line 10 according to the first preferred embodiment. Other elements and features of the third preferred embodiment are the same or substantially the same as that of the transmission line 10 according to the first preferred embodiment.

As illustrated in FIG. 5A and FIG. 5B, the dielectric base body 90 includes a plurality of through holes 80. The plurality of through holes 80 extend through the dielectric base body 90 from the top surface to the mounting surface of the dielectric base body 90. The plurality of through holes 80 are arranged between the first signal conductor 210 and the ground conductor 31, between the first signal conductor 210 and the ground conductor 32 or 41, between the second signal conductor 220 and the ground conductor 41 or 32, and between the second signal conductor 220 and the ground conductor 42 in a direction in which the first and second signal conductors 210 and 220 extend.

The third preferred embodiment provides air layers between the first signal conductor 210 and the ground conductor 31 and between the first signal conductor 210 and the ground conductor 32, thus reducing capacitive coupling between the first signal conductor 210 and the ground conductor 31 and capacitive coupling between the first signal conductor 210 and the ground conductor 32. This may reduce the space between the first signal conductor 210 and the ground conductor 31 and the space between the first signal conductor 210 and the ground conductor 32, further narrowing the width of the dielectric base body 90. Accordingly, the size of the transmission line 10B may further be reduced.

The third preferred embodiment above also provides air layers between the second signal conductor 220 and the ground conductor 41 and between the second signal conductor 220 and the ground conductor 42, thereby reducing capacitive coupling between the second signal conductor 220 and the ground conductor 41 and capacitive coupling between the second signal conductor 220 and the ground conductor 42. This may reduce the space between the second signal conductor 220 and the ground conductor 41 and the space between the second signal conductor 220 and the ground conductor 42, further narrowing the width of the dielectric base body 90. Accordingly, the size of the transmission line 10B is able to be further reduced.

In addition, the plurality of through holes 80 increase the pliability of the dielectric base body 90. Accordingly, the flexibility of the transmission line 10B is improved.

Fourth Preferred Embodiment

Figure 6A:
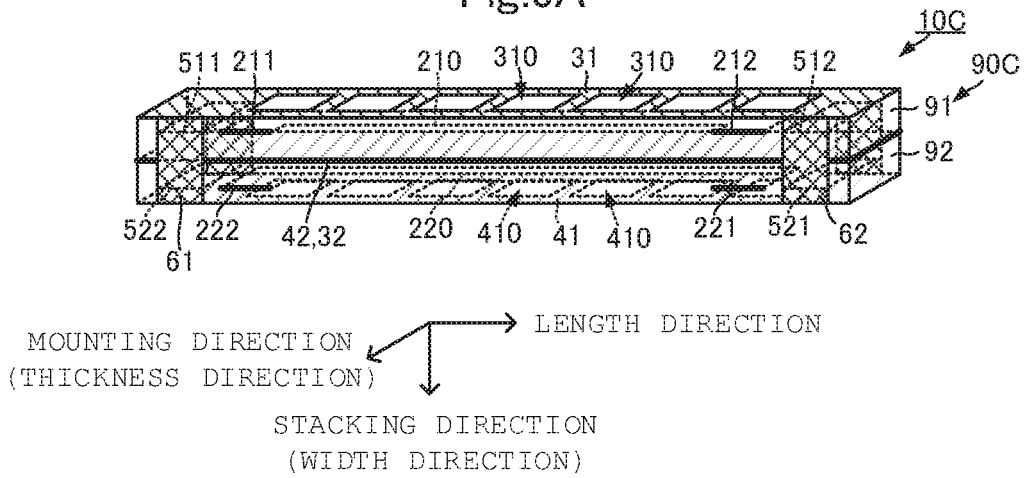
FIG. 6A is an external perspective view a transmission line according to a fourth preferred embodiment of the present invention.

A transmission line according to a fourth preferred embodiment of the present invention is described below with reference to the drawings. FIG. 6A is an external perspective view of the transmission line according to the fourth preferred embodiment, and FIG. 6B is a view of the transmission line according to the fourth preferred embodiment as viewed from the top surface.

A transmission line 100 according to the fourth preferred embodiment is different from the transmission line 10 according to the first preferred embodiment in the way in which the first base body 91 and the second base body 92 are stacked and in the specific configuration and arrangement of the ground conductors 31 and 41. Other elements and features of the fourth preferred embodiment are the same or substantially the same as that of the transmission line 10 according to the first preferred embodiment.

Figure 6B:
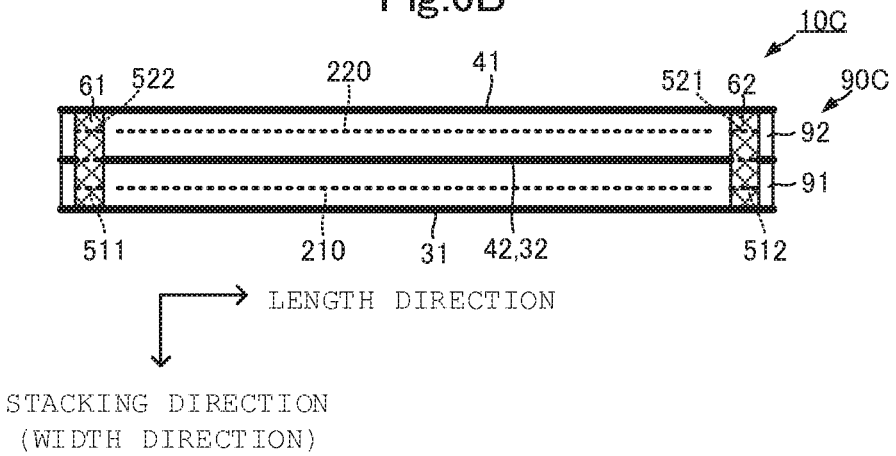
FIG. 6B is a view of the transmission line as viewed from a top surface.

As illustrated in FIG. 6A and FIG. 6B, the transmission line 100 includes a dielectric base body 90C. In the dielectric base body 90C, the first base body 91 and the second base body 92 are stacked on top of each other, and the ground conductor 32 of the first base body 91 and the ground conductor 42 of the second base body 92 abut against or are adjacent to each other.

In addition, the ground conductor 31, which defines a side surface conductor of the dielectric base body 90C, includes opening portions 310. The opening portions 310 are areas where no conductors are defined in the ground conductor 31, and the areas where no conductors are defined may be included as cutaway portions. A plurality of opening portions 310 are defined in the ground conductor 31, and are arranged in a direction in which the first signal conductor 210 extends. In other words, the ground conductor 31 of the dielectric base body 90C includes two elongated conductors and a plurality of bridge conductors. The two elongated conductors extend along the first signal conductor 210. The two elongated conductors are arranged so as not to overlap the first signal conductor 210 when viewed in a direction orthogonal or substantially orthogonal to a side surface of the dielectric base body 90C. The plurality of bridge conductors connect the two elongated conductors at predetermined intervals in the elongated direction of the two elongated conductors.

The ground conductor 41, which defines a side surface conductor of the dielectric base body 90C, includes opening portions 410. The opening portions 410 are areas where no conductors are defined in the ground conductor 41, and the areas where no conductors are defined may be included as cutaway portions. A plurality of opening portions 410 are defined in the ground conductor 41, and are arranged in a direction in which the second signal conductor 220 extends. In other words, the ground conductor 41 of the dielectric base body 90C includes two elongated conductors and a plurality of bridge conductors. The two elongated conductors extend along the second signal conductor 220. The two elongated conductors are arranged so as not to overlap the second signal conductor 220 when viewed in a direction orthogonal or substantially orthogonal to a side surface of the dielectric base body 90C. The plurality of bridge conductors connect the two elongated conductors at predetermined intervals in the elongated direction of the two elongated conductors.

The fourth preferred embodiment reduces capacitive coupling between the first signal conductor 210 and the ground conductor 31, and reduces the space between the first signal conductor 210 and the ground conductor 31. Accordingly, the width of the dielectric base body 90C may be reduced. The fourth preferred embodiment also reduces capacitive coupling between the second signal conductor 220 and the ground conductor 41, and reduces the space between the second signal conductor 220 and the ground conductor 41.

Accordingly, the width of the dielectric base body 90C is able to be further reduced. Thus, the size of the transmission line 100 is able to be further reduced.

Fifth Preferred Embodiment

Figure 7:
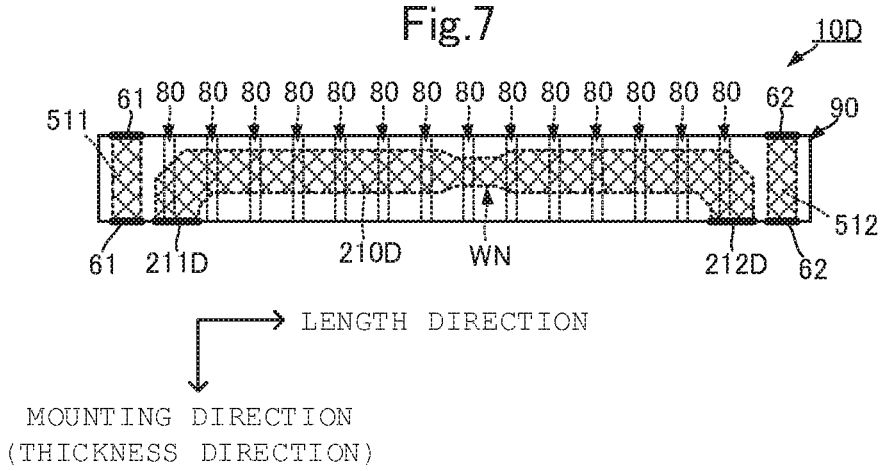
FIG. 7 is a view of a transmission line according to a fifth preferred embodiment of the present invention as viewed from a first side surface.

A transmission line according to a fifth preferred embodiment of the present invention is described below with reference to the drawings. FIG. 7 is a view of the transmission line according to the fifth preferred embodiment as viewed from the first side surface. In FIG. 7, the illustration of ground conductors on side surfaces of a dielectric base body is omitted for ease of understanding of the internal structure.

A transmission line 10D according to the fifth preferred embodiment is different from the transmission line 10 according to the first preferred embodiment in the specific configuration and arrangement of a first signal conductor 210D. Other elements and features of the fifth preferred embodiment are the same or substantially the same as that of the transmission line 10 according to the first preferred embodiment.

The first signal conductor 210D includes a narrower-width portion WN. The narrower-width portion WN is a portion of the first signal conductor 210D that is narrower in width than other portions of the first signal conductor 210D. The pliability of the dielectric base body 90 may be increased at the narrower-width portion WN. In the fifth preferred embodiment, a single narrower-width portion WN is provided. Alternatively, a plurality of narrower-width portion s WN may be provided.

A lead conductor 211D located at one end of the first signal conductor 210D is curved stepwise, rather than being curved once to define a right angle bend, with respect to a principal portion of the first signal conductor 210D. For example, in the example illustrated in FIG. 7, the lead conductor 211D is bent twice and each bend angle is approximately 45°. Accordingly, transmission loss between the principal portion of the first signal conductor 210D and the lead conductor 211D may be significantly reduced.

While only the first signal conductor 210D is illustrated in the fifth preferred embodiment, the second signal conductor 220 may include a similar structure.

Sixth Preferred Embodiment

Figure 8A:
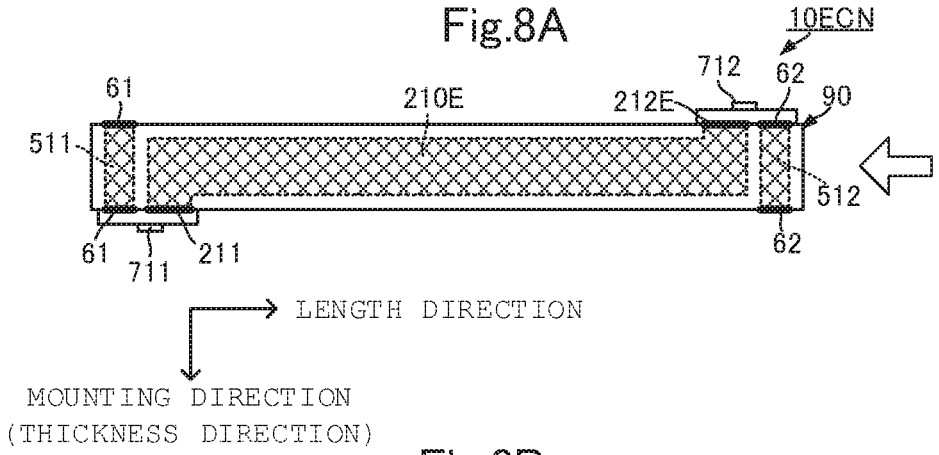
FIG. 8A is a view of a transmission line according to a sixth preferred embodiment of the present invention as viewed from a first side surface.
Figure 8B:
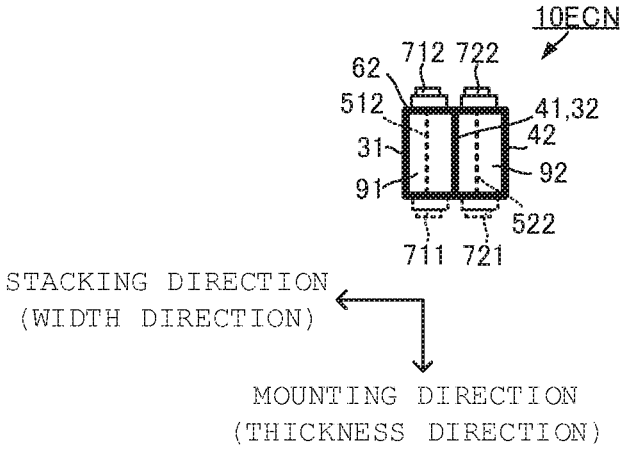
FIG. 8B is a view of the transmission line as viewed from a second end surface.

A transmission line according to a sixth preferred embodiment of the present invention is described below with reference to the drawings. FIG. 8A is a view of the transmission line according to the sixth preferred embodiment as viewed from the first side surface. In FIG. 8A, the illustration of ground conductors on side surfaces of a dielectric base body is omitted for ease of understanding of the internal structure. FIG. 8B is a view of the transmission line according to the sixth preferred embodiment as viewed from the second end surface.

A transmission line 10ECN according to the sixth preferred embodiment is different from the transmission line 10CN according to the first preferred embodiment in the specific configuration and arrangement of a first signal conductor 210E and in the positions at which the connector terminals 712 and 722 are connected to the dielectric base body 90. Other elements and features of the sixth preferred embodiment are the same or substantially the same as that of the transmission line 10CN according to the first preferred embodiment.

A lead conductor 211 of the first signal conductor 210E and a lead conductor 212E of the first signal conductor 210E extend in opposite directions with respect to the position at which the first signal conductor 210E is defined, when the dielectric base body 90 is viewed from a side surface. The lead conductor 212E is exposed on the top surface of the dielectric base body 90. The connector terminals 712 and 722 are placed on the top surface of the dielectric base body 90. The connector terminal 712 is connected to the lead conductor 212E and the auxiliary ground conductor 512. The connector terminal 722 is connected to a lead conductor (not illustrated), which may include a modification of the lead conductor 212 of the transmission line 10CN according to the first preferred embodiment, and the auxiliary ground conductor 522. That is, in the transmission line 10ECN according to the sixth preferred embodiment, two surfaces orthogonal or substantially orthogonal to a side surface and an end surface serve as mounting surfaces. The sixth preferred embodiment provides advantages similar to those described above with respect to the first though fifth embodiments.

While the sixth preferred embodiment illustrates an example in which two ends of two signal conductors on the first end surface side are exposed on the bottom surface, that is, the mounting surface of a transmission line according to any other preferred embodiment, and the other two ends of the two signal conductors on the second end surface side are exposed on the top surface, any other arrangement or configuration of lead conductors may be included. For example, both ends of one of the two signal conductors may be exposed on the bottom surface and both ends of the other signal conductor may be exposed on the top surface.

Seventh Preferred Embodiment

Figure 9A:
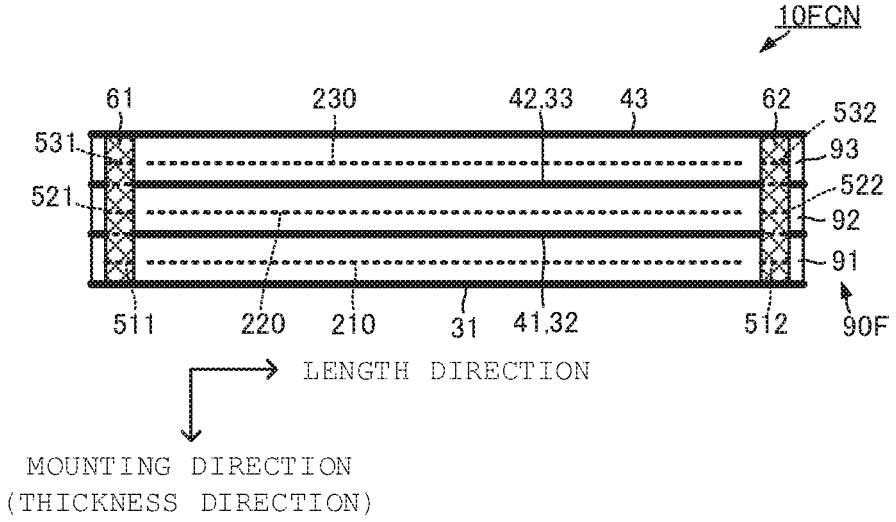
FIG. 9A is a view of a transmission line according to a seventh preferred embodiment of the present invention as viewed from a top surface.
Figure 9B:
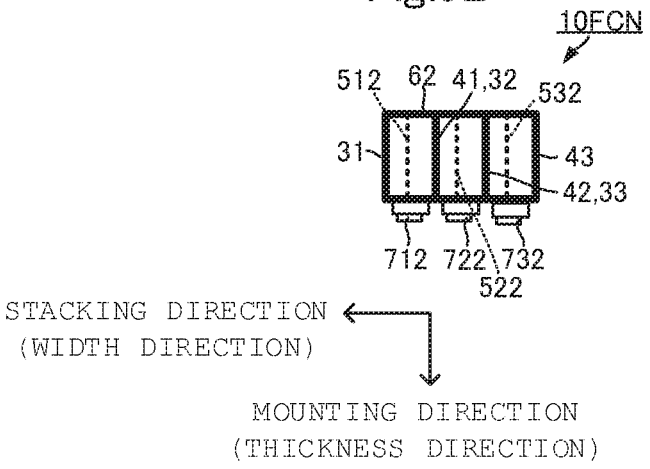
FIG. 9B is a view of the transmission line as viewed from a second end surface.

A transmission line according to a seventh preferred embodiment of the present invention is described below with reference to the drawings. FIG. 9A is a view of the transmission line according to the seventh preferred embodiment as viewed from the top surface. FIG. 9B is a view of the transmission line according to the seventh preferred embodiment as viewed from the second end surface.

A transmission line 10FCN according to the seventh preferred embodiment is different from the transmission line 10CN according to the first preferred embodiment in that a dielectric base body 90F includes three transmission lines.

The dielectric base body 90F according to the seventh preferred embodiment includes a first base body 91, a second base body 92, and a third base body 93. The first base body 91 and the second base body 92 are the same or substantially the same as those of the transmission line 10CN according to the first preferred embodiment.

Although not illustrated in detail in the drawings, the third base body 93 includes features and elements that are similar to the first and second base bodies 91 and 92. The third base body 93 includes a third signal conductor 230 located between ground conductors 33 and 43 in the stacking direction. A connector terminal 732 is connected to an auxiliary ground conductor 532 and a lead conductor that defines an end of the third signal conductor 230 on the second end surface side. Although not illustrated in the drawings, an auxiliary ground conductor 531 and a lead conductor that defines an end of the third signal conductor 230 on the first end surface side are connected to a connector terminal.

The first base body 91 and the second base body 92 are stacked so that the ground conductor 41 and the ground conductor 32 abut against or are adjacent to each other. The second base body 92 and the third base body 93 are stacked so that the ground conductor 42 and the ground conductor 33 abut against or are adjacent to each other.

Modifications of the Preferred Embodiments

A dielectric base body may not necessarily include two transmission lines. A dielectric base body including three transmission lines may also achieve advantages similar to those of the first preferred embodiment.

The second and subsequent preferred embodiments described above illustrate modifications of a specific preferred embodiment. Characteristic features and elements of different preferred embodiments may be combined with one another.

In the preferred embodiments described above, a ground conductor is provided on each side surface of a dielectric base body, by way of example. However, a ground conductor provided between signal conductors that are adjacent to or in a vicinity of one another in a stacking direction of dielectric layers and the stacking direction of the dielectric layers is orthogonal or substantially orthogonal to a mounting surface of a transmission line may provide the advantages described above.

In the preferred embodiments described above, separate base bodies each defining a transmission line are stacked on top of each other to define a dielectric base body. Alternatively, one of ground conductors abutting against or adjacent to each other included in a dielectric base body may be omitted, for example, the ground conductor 41 and the ground conductor 32 of the transmission line 10 according to the first preferred embodiment, and a plurality of dielectric layers may be stacked on top of one another and then subjected to thermocompression bonding altogether to define the dielectric base body.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A transmission line comprising:

a dielectric base body including a plurality of dielectric layers that are stacked on top of one another;

a plurality of signal conductors located in the dielectric base body; and a first ground conductor located on one of the plurality of dielectric layers and facing the plurality of signal conductors; wherein the plurality of signal conductors include:

a film-shaped first signal conductor; and a film-shaped second signal conductor;

the first signal conductor and the second signal conductor are electrically disconnected from each other and located at different positions in a stacking direction of the plurality of dielectric layers;

the first ground conductor is film-shaped and includes a width wider than a width of the first signal conductor and a width of the second signal conductor, and is located between the first signal conductor and the second signal conductor in the stacking direction of the plurality of dielectric layers;

at least one end of each of the first signal conductor and the second signal conductor is curved in a direction orthogonal or substantially orthogonal to the stacking direction as viewed in the stacking direction and is exposed to an exterior of the transmission line from a surface of the dielectric base body parallel or substantially parallel to the stacking direction;

the ends of the first signal conductor and the second signal conductor include lead conductors, the lead conductors and the dielectric layers in which the lead conductors are located include a projecting portion that is a portion projecting from a surface of the dielectric base body parallel or substantially parallel to the stacking direction; and the projecting portion includes a plurality of projections that at least partially overlap in the stacking direction.

2. The transmission line according to claim 1, wherein:

the surface of the dielectric base body parallel or substantially parallel to the stacking direction includes a mounting surface; and the mounting surface is a surface on which the first signal conductor and the second signal conductor are exposed to the exterior of the transmission line.

3. The transmission line according to claim 1, further comprising:

a second ground conductor located opposite to the first ground conductor with the first signal conductor positioned between the first ground conductor and the second ground conductor in the stacking direction of the plurality of dielectric layers; and a third ground conductor located opposite to the first ground conductor with the second signal conductor positioned between the first ground conductor and the third ground conductor in the stacking direction of the plurality of dielectric layers.

4. The transmission line according to claim 3, further comprising a ground connection conductor located on the surface of the dielectric base body parallel or substantially parallel to the stacking direction and that connects the first ground conductor, the second ground conductor, and the third ground conductor.

5. The transmission line according to claim 4, further comprising:

a first auxiliary ground conductor located in a layer identical to a layer in which the first signal conductor is located; and a second auxiliary ground conductor located in a layer identical to a layer in which the second signal conductor is located; wherein the ground connection conductor is further connected to the first auxiliary ground conductor and the second auxiliary ground conductor.

6. The transmission line according to claim 5, wherein the first auxiliary ground conductor and the second auxiliary ground conductor are located between the third ground conductor and the second ground conductor in the stacking direction.

7. The transmission line according to claim 4, wherein at least one of the second ground conductor and the third ground conductor includes an opening portion or a cutaway portion, the opening portion or the cutaway portion being an area where no conductor is defined.

8. The transmission line according to claim 1, wherein a first partial air layer is defined between the first signal conductor and the first ground conductor, and a second partial air layer is defined between the second signal conductor and the first ground conductor.

9. The transmission line according to claim 1, wherein the first signal conductor does not extend to both ends of the transmission line.

10. A transmission line comprising:

a dielectric base body including a plurality of dielectric layers that are stacked on top of one another;

a plurality of signal conductors located in the dielectric base body; and a first ground conductor located in the plurality of dielectric layers and facing the plurality of signal conductors; wherein the plurality of signal conductors include:

a film-shaped first signal conductor; and a film-shaped second signal conductor;

the first signal conductor and the second signal conductor are electrically disconnected from each other and located at different positions in a stacking direction of the plurality of dielectric layers;

at least one signal conductor among the first signal conductor and the second signal conductor includes a lead conductor at an end portion of the at least one signal conductor, the lead conductor being located on a dielectric layer among the plurality of dielectric layers;

the lead conductor and the dielectric layer in which the lead conductor is located include a projecting portion that is a portion projecting from a surface of the dielectric base body parallel or substantially parallel to the stacking direction;

the projecting portion includes a plurality of projections that at least partially overlap in the stacking direction;

the projecting portion is flexible; and the first ground conductor is filmed-shaped and includes a width wider than a width of the first signal conductor and a width of the second signal conductor, and is located between the first signal conductor and the second signal conductor in the stacking direction of the plurality of dielectric layers.

11. The transmission line according to claim 10, wherein the projecting portion is bent.

12. The transmission line according to claim 10, further comprising:

a second ground conductor located opposite to the first ground conductor with the first signal conductor positioned between the first ground conductor and the second ground conductor in the stacking direction of the plurality of dielectric layers; and a third ground conductor located opposite to the first ground conductor with the second signal conductor positioned between the first ground conductor and the third ground conductor in the stacking direction of the plurality of dielectric layers.

13. The transmission line according to claim 12, further comprising a ground connection conductor located on the surface of the dielectric base body parallel or substantially parallel to the stacking direction and that connects the first ground conductor, the second ground conductor, and the third ground conductor.

14. The transmission line according to claim 13, further comprising:

a first auxiliary ground conductor located in a layer identical to a layer in which the first signal conductor is located; and a second auxiliary ground conductor located in a layer identical to a layer in which the second signal conductor is located; wherein the ground connection conductor is further connected to the first auxiliary ground conductor and the second auxiliary ground conductor.

15. The transmission line according to claim 13, wherein at least one of the second ground conductor and the third ground conductor includes an opening portion or a cutaway portion, the opening portion or the cutaway portion being an area where no conductor is defined.

16. The transmission line according to claim 10, wherein a partial air layer is defined between the first signal conductor and the first ground conductor, and a partial air layer is defined between the second signal conductor and the first ground conductor.

17. The transmission line according to claim 16, wherein the partial air layer includes through holes extending through the dielectric base body that are defined in a direction in which the first signal conductor and the second signal conductor extend and in the direction orthogonal or substantially orthogonal to the stacking direction between the first signal conductor and the first ground conductor and between the second signal conductor and the first ground conductor.

18. The transmission line according to claim 10, wherein the first lead conductor and the second lead conductor are exposed to an exterior of the transmission line.

* * * * *